United States Patent [19]

Dingerkus

[11] Patent Number: 4,648,539

[45] Date of Patent: Mar. 10, 1987

[54] CONTROL DEVICE FOR GUIDING A MATERIAL WEB

[75] Inventor: Heinz-Ludwig Dingerkus, Attendorn, Fed. Rep. of Germany

[73] Assignee: Elektro-Mechanik GmbH, Fed. Rep. of Germany

[21] Appl. No.: 583,831

[22] Filed: Feb. 27, 1984

[30] Foreign Application Priority Data

Mar. 3, 1983 [DE] Fed. Rep. of Germany ..... 3307499

[51] Int. Cl.[4] ..... B65H 23/038

[52] U.S. Cl. ..... 226/19; 226/21

[58] Field of Search ..... 226/15, 16, 17, 19, 226/20, 21, 18, 22, 23; 242/57.1, 57

[56] References Cited

U.S. PATENT DOCUMENTS

| | | | |
|---|---|---|---|
| 2,654,599 | 10/1953 | Frisbie et al. | 226/21 |
| 2,716,026 | 8/1955 | Axworthy | 226/21 |
| 3,017,062 | 1/1962 | Watt et al. | 226/21 X |
| 3,040,944 | 6/1962 | Andersen | 226/21 |
| 3,313,461 | 4/1967 | Andersen | 226/21 X |
| 3,323,699 | 6/1967 | Bricker, Jr. | 226/21 X |
| 3,343,737 | 9/1967 | Alexeff et al. | 226/21 |
| 3,568,904 | 3/1971 | Kurz | 226/15 |
| 3,610,494 | 10/1971 | Minton | 226/21 |
| 3,664,561 | 5/1972 | Feiertag | 226/21 |

FOREIGN PATENT DOCUMENTS

| | | | |
|---|---|---|---|
| 1151423 | 7/1963 | Fed. Rep. of Germany | 226/20 |

*Primary Examiner*—Harvey C. Hornsby
*Assistant Examiner*—Scott J. Haugland
*Attorney, Agent, or Firm*—McGlew and Tuttle

[57] ABSTRACT

A control device for guiding edges or a centerline of a material web which moves over rollers utilizes the difference between a desired position value and an actual position value, which actual position value is multiplied by a signal corresponding to the speed of the material web. A control signal is generated which is applied to a control element to reposition the web to obtain the desired positions for the edges or centerline. To make the control hunting-free, the error signal, formed of the actual value measured at a predetermined location, and the desired value is multiplied by the speed of the web and is delivered to a first control circuit for stabilization. A second control circuit, subordinate to the first, is provided between the output of an integrator and the correcting element and this second circuit comprises a position controller for the correcting element for receiving error signals which are formed of the output signal of the integrator representing the desired value, and the actual value of the correcting element.

11 Claims, 3 Drawing Figures

CONTROL DEVICE FOR GUIDING A MATERIAL WEB

FIELD AND BACKGROUND OF THE INVENTION

The present invention relates in general to control devices for controlling the movement of sheet like material, and in particular, to a new and useful control device for guiding edges or a centerline of a material web which moves over rollers utilizing a circuit which responds to actual position values as well as speed values for the material web to produce a signal for controlling a controlling element to properly align or reposition the material web.

While manufacturing and processing web-like or sheet-like materials, it is well known to employ control devices for exactly guiding the edges or the centerline of the material web or sheet. Controllers with hydraulically or electrically actuated correcting elements are used for this purpose, with the correcting elements being embodied by reels and/or control rollers. To obtain a control which is free from hunting, the device for measuring the position of the web must be provided in close proximity to the associated correcting element. This, however, is frequently impossible, for example in instances where the web of material is guided through a kiln that is heated to a high temperature, or through a wet region. In such instances, the position of the web must be determined at a location which is remote from the correcting element, and this as a rule, results in an undesirable hunting movement of the webs.

According to U.S. Pat. No. 3,568,904, such a hunting motion may be eliminated by timing the adjustment of the correcting elements, or adjusting them stepwise.

A similar situation arises if the correcting element cannot be built in because of the layout of the unit, or if for technological reasons the control must be provided in the preceding zone. In such instances, a second measuring device may be provided at the location where the accuracy in guidance is wanted, and the measuring device which is mounted close downstream of the correcting element is then adjusted stepwise, with the timing depending on the speed in the unit (U.S. Pat. No. 3,568,904).

It is disadvantageous in this timed prior art control that the correcting signal is not proportional to the run of the web, so that this run cannot be adjusted to an exact zero deviation.

SUMMARY OF THE INVENTION

The present invention is directed to an improved control device of the above-mentioned kind which controls the run of the web continuously, without hunting, and adjusts a zero deviation.

Accordingly an object of the present invention is to provide a control device for exactly guiding edges or centerlines of material webs which move over rollers and are guided by a correcting element and whose position is ascertained by determining a deviation from a desired value for the web position, the deviation for the desired value being obtained by multiplying an actual value for the position at a predetermined location multiplied by the speed of the material web.

The inventive control device has the advantage that an otherwise needed control roller can be omitted, while still maintaining a continuous control. Another advantage is that even in arrangements where the error value is determined at a location remote from the correcting element, a continuous control is ensured.

The actual value is measured by means of a measuring device provided at a location remote from the correcting element. In a preferred arrangement, the deviation of the control as variable is transmitted through a proportional controller to the first input of a multiplier and the speed of the web is applied to the other input of the multiplier, and the multiplier is followed by an integrator whose output signal is used for controlling the correcting element.

The control action may further be improved by providing a second control circuit which is subordinate to the first one and which is connected between the output of the integrator and the correcting element and comprises a controller for positioning the correcting element, with the position controller being supplied with an actual signal formed of the output of the integrator, which is the desired value, and the actual value of the correcting element or the actual value of the run of the web immediately downstream of the correcting element.

A further object of the invention is to provide a control device for controlling the movement of a material web which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
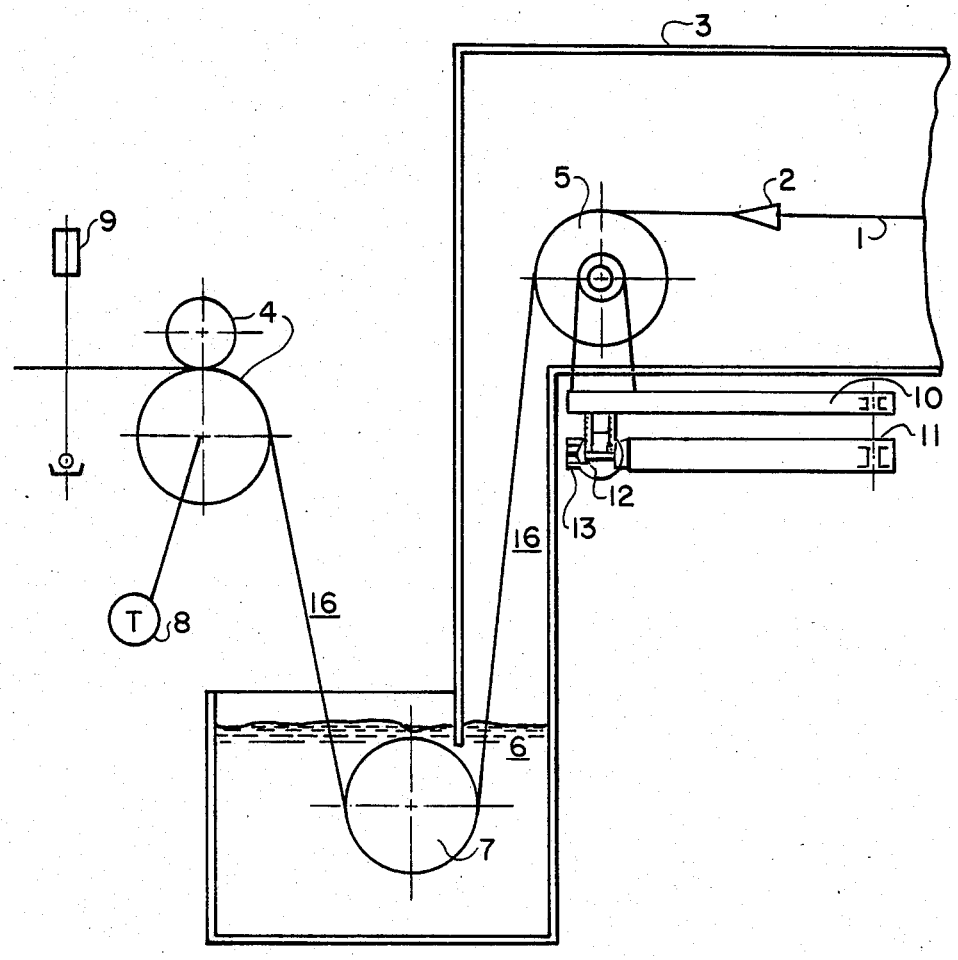
FIG. 1 is a diagrammatical illustration of one embodiment of the invention.

Referring to the drawings, like parts are designated with the same reference numerals.

In FIG. 1, a web of materiall runs in the direction of arrow 2 through a kiln 3. The web is driven through drive rollers 4. A reel provided at the right hand side of the figure and in front of the kiln is not included in the subject matter of this embodiment and therefore not shown. Web 1 runs over a control roller 5 performing the function of a correcting element, to a water tank 6 serving as a water seal at this side, confining the protective gas in the kiln. The web is then strained over a deflection roller 7 to the two drive rollers 4. Drive roller 4 is connected to a tachometer 8 for measuring the speed of the web. Downstream of the drive rollers, a measuring device 9 is provided for determining the position of the web. At this location, the actual value of the position is measured, which is needed for determining the error value. As already mentioned, the correcting element is embodied by control roller 5. In the present example, control roller 5 is mounted on a support 10, for pivoting about an axis 11. The pivoting is effected hydraulically by means of an actuating cylinder 12. The position of the support and thus of the control roller is measured by means of a position pickup 13.

Figure 2:
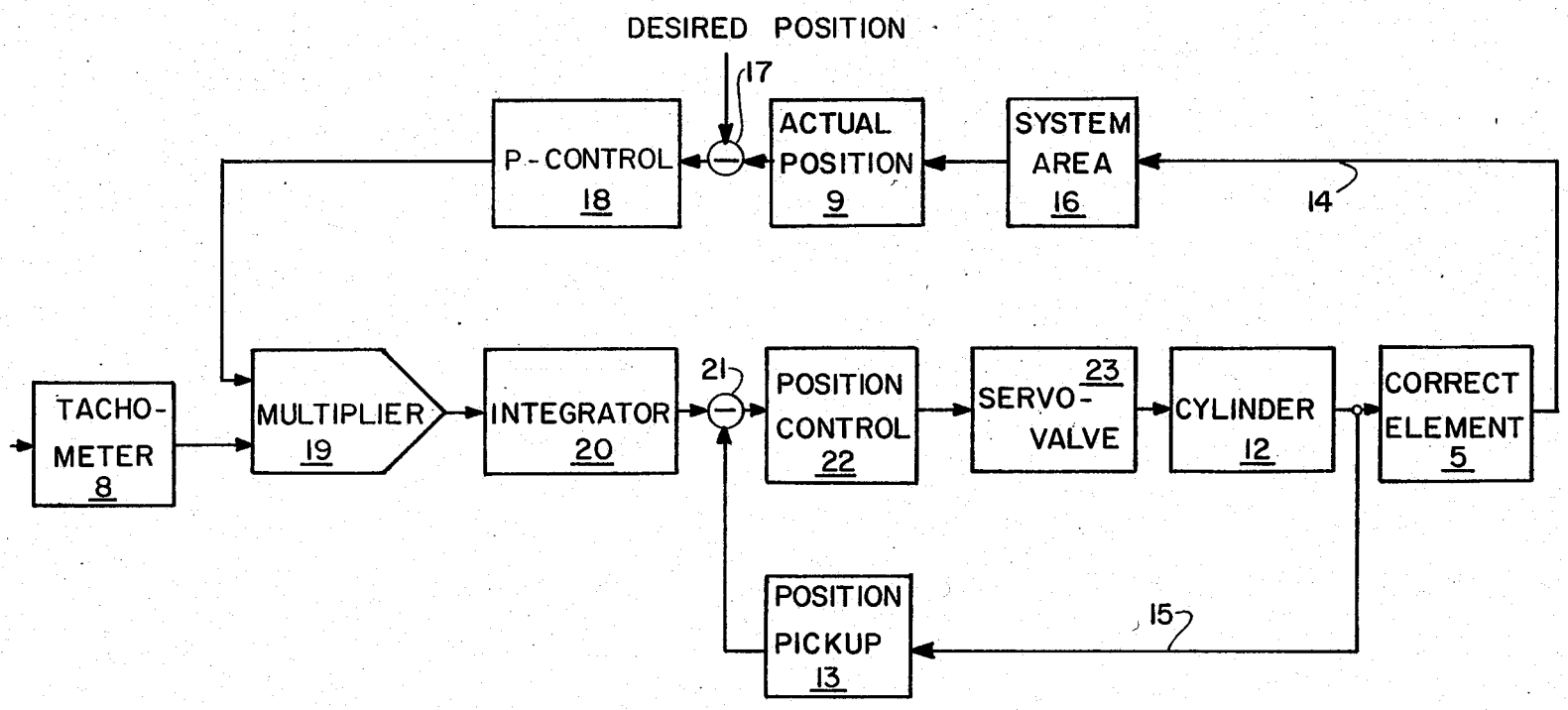
FIG. 2 is a block diagram of the inventive control device.

FIG. 2 shows a first control circuit starting at 14 and a second control circuit starting at 15 associated therewith. The controlled area or system within which a deviation of the web run is to be eliminated is shown at 16 in FIG. 1 and extends between control roller 5 and the drive rollers 4. Downstream thereof, measuring device 9 is provided for measuring the actual value. This actual value, i.e. the actual position of the web, and the predetermined desired value are delivered to a summing point or unit 17 whose output (the difference value) is applied to the input of a proportional controller 18. The circumstance underlying the invention is that the lateral or deviation speed of the running web within the extension of controlled area 16 equals the product of the advancing speed of the web and the difference value. Therefore, the output signal of proportional controller 18 is applied to the first input of a multiplier 19. The speed of the web is supplied to the control circuit through the second input of the multiplier. For this purpose, the output of tachometer 8 is supplied to the second input of multiplier 19. Multiplier 19 is followed by an integrator 20. The error signal is derived from the output signal of the integrator, by which control roller 5 is adjusted.

To form the second control circuit starting at 15, a position pickup 13 is connected between the input of correcting element 5 and a summing point 21. The output of the integrator is also applied to this summing point. The output of integrator 20 is the desired value (set point) for control circuit 15. The position of the control roller, i.e. the correcting element 5, is the actual value. The position of the correcting element is detected or measured by means of position pickup 13. The error signal (difference between actual and desired roller position) is then applied to a position controller 22 whose output signal actuates a servo valve 23 which in turn hydraulically actuates cylinder 12 by which correcting element 5 is hydraulically adjusted. The effect of the two control circuits (at 14, 15) may also be so interpreted that multiplier 19 and integrator 20 form a stabilizing member for the control circuit at 14. Position controller 22 has the characteristic of a proportional controller which is followed by servovalve 21 and actuating cylinder 12 as an integral member.

Figure 3:
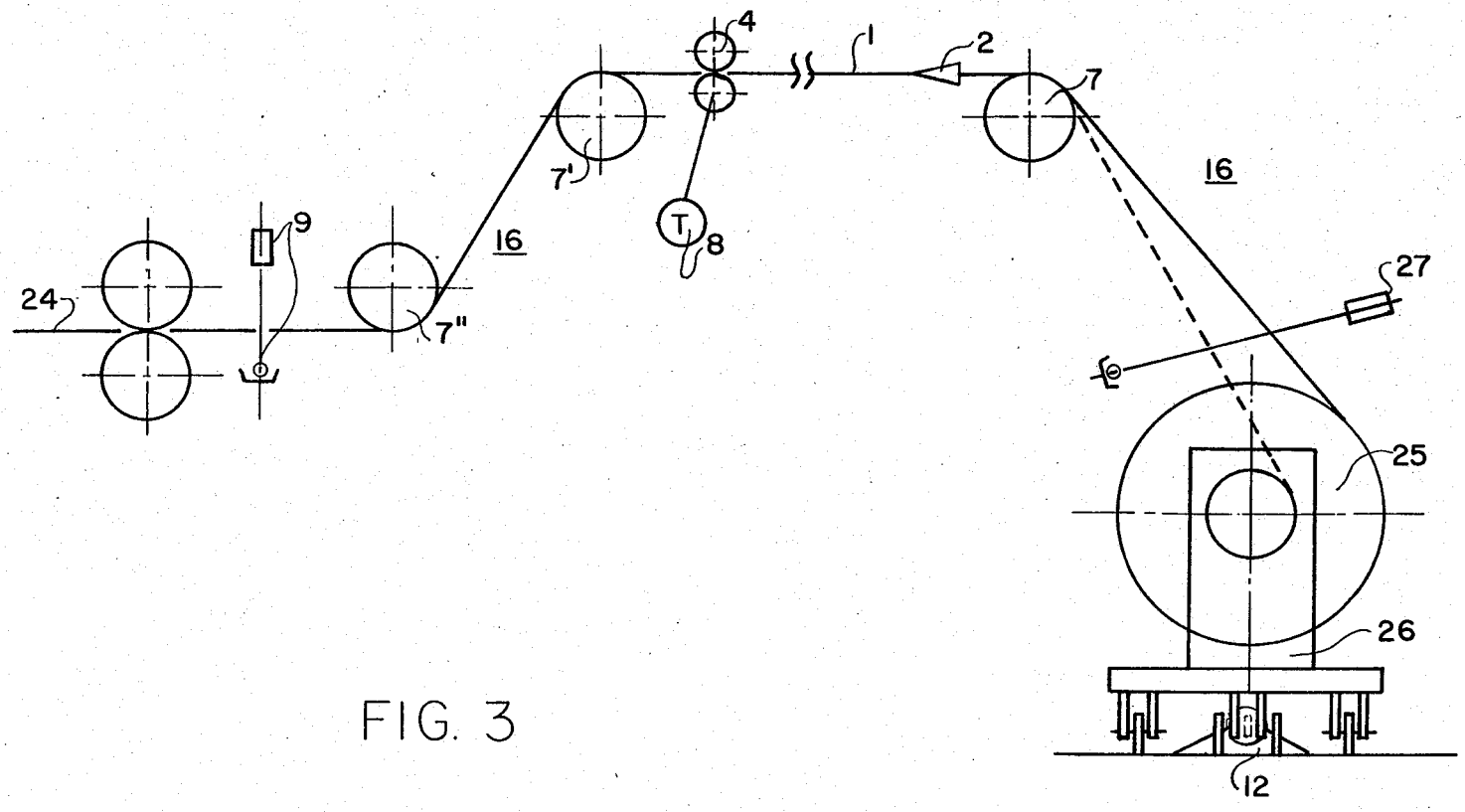
FIG. 3 diagrammatically shows another embodiment of the invention.

FIG. 3 shows another embodiment of the invention. Web 1 is wound off a reel 25 in the direction of arrow 2, by means of drive rollers 4. Between the reel and the working station 24, the web is run about three deflection rollers 7, 7', 7''. To control the run of the web, reel 25 is equipped with a frame 26 which is designed as a correcting element acted upon by the piston rod of an actuating cylinder 12. The actual position of the running web is measured first close downstream of reel 25 by means of a measuring device 27, and then upstream of the working station 24 by means of measuring device 9. Devices 9 and 27 may be electric eyes or any other known position sensing arrangement. Drive rollers 4 are again connected to a tachometer 8 for measuring the speed of the web. The position of the reel is adjusted perpendicularly to the run of the web. The control system is generally designated 16. The circuitry is designed in accordance with FIG. 2. To form the second control circuit 15, the output of measuring device 27 which is provided adjacent correcting element 25 is applied to the summing point 21. In FIG. 2. measuring device 27 corresponds to position pickup 13. The output signal of integrator 20 is applied to the summing point. The output signal of integrator 20 is the desired value for control circuit 15. The position of web 1 downstream of correcting element 25 is the actual value. The error signal is applied to position controller 22 whose output signal actuates a following servovalve 21 which in turn hydraulically actuates cylinder 12 by which the correcting element is hydraulically adjusted.

While specific embodiments of the invention have been shown and described in detail to illustrate the application of the principles of the invention, it will be understood that the invention may be embodied otherwise without departing from such principles.

What is claimed is:

1. A control device for continuously controlling the position of a material web which is guided over at least one roller in a controlled area, comprising:

position correcting means engaged with the web at a first location of the controlled area to reposition the web in the controlled area;

actual position sensing means for continuously sensing the actual position of the material web in the controlled area to generate an actual web position signal;

speed sensing means for continuously sensing the speed of the web in the controlled area to generate a web speed signal;

a difference unit having a desired web position signal and connected to said actual position sensing means for obtaining a difference signal corresponding to a difference between the desired web position signal and the actual web position signal;

a multiplier connected to said difference unit and said speed sensing means for multiplying said difference signal by said web speed signal to obtain a corrected difference signal; and circuit means connected to said multiplier and said position controlling means for controlling said position correcting means in accordance with said corrected difference signal to reposition the web.

2. A control device according to claim 1, wherein said actual position sensing means senses the position of the web at a location remote from the location at which said position correcting means engages the web.

3. A control device for continuously controlling the position of a material web which is guided over at least one roller in a controlled area comprising:

position correcting means engaged with the web at a first location of the controlled area to reposition the web;

first actual position sensing means at said first location for continuously generating an actual correcting means position signal corresponding to an actual position of the correcting means;

second actual position sensing means at a second location spaced from said first location of the controlled area for continuously generating an actual web position signal corresponding to the actual position of the material web at said second location;

speed sensing means for continuously sensing the speed of the web at said second location to generate a web speed signal;

a first difference unit for receiving a desired web position signal corresponding to a desired position signal for the web in the controlled area, said first difference unit connected to said second actual position sensor for generating a first difference signal corresponding to a difference between said actual and said desired web position signal;

a proportional controller connected to said first difference unit for proportioning said first difference signal to said web speed signal;

a multiplier having a first input connected to said proportional controller for receiving said first difference signal and a second input connected to said speed sensing means for receiving said web speed signal, said multiplier multiplying said web speed signal by said first difference signal after it has been proportioned by said proportional controller to generate a second difference signal;

an integrator connected to said multiplier for integrating said second difference signal to generate a corrected difference signal;

a second difference unit connected to said integrator and to said first actual position sensor for obtaining a difference between said corrected difference signal and said actual correcting means position signal to generate a position control signal, said position control signal being applied to said position correcting means for repositioning the web.

4. A control device according to claim 3, wherein said position correcting means includes a position controller connected to said second difference unit for receiving said position control signal and web moving means for moving said web in response to said position control signal.

5. A control device according to claim 4, wherein said first actual position sensing means is positioned adjacent to and downstream of said position controlling means in a direction of movement of the web in said controlled area.

6. A control device according to claim 5, wherein said position controller comprises an additional proportional controller.

7. A control device according to claim 5, wherein said web moving means comprises a servo valve connected to said position controller for activation in accordance with said position control signal, an actuating cylinder connected to said servo valve and being controlled by said servo valve, a piston movable in said cylinder and a web guider connected to said piston for moving guiding the web.

8. A control device according to claim 3, wherein said position control means comprises a web engaging roller, a support for rotatably supporting said roller and drive means for moving said support for moving the web.

9. A control device according to claim 3, wherein said position correcting means comprises a reel for discharging material web, a support for rotatably supporting said reel and drive means for moving said support parallel to an axis of said reel to reposition the web.

10. A control device according to claim 3, wherein said speed sensing means comprises at least one drive roller for driving the web in said controlled area and a tachometer connected to said drive roller for measuring a speed of rotation of said drive roller.

11. A control device for continuously controlling the position of a material which is guided over at least one roller in a controlled area, comprising:

position correcting means engaged with the web at a first location of the controlled area to reposition the web in the controlled area;

actual position sensing means for continuously sensing the actual position of the material web in the controlled area to generate an actual web position signal, said actual position sensing means sensing the position of the web at a location remote from the location at which said position correcting means engages the web;

speed sensing means for continuously sensing the speed of the web in the controlled area to generate a web speed signal;

a difference unit having a desired web position signal and connected to said actual position sensing means for obtaining a difference signal corresponding to a difference between the desired web position signal and the actual web position signal;

a multiplier connected to said difference unit and said speed sensing means for multiplying said difference signal by said web speed signal to obtain a corrected difference signal;

circuit means connected to said multiplier and said position controlling means for continuously controlling said position correcting means in accordance with said corrected difference signal to reposition the web; and a proportional controller connected between said multiplier and said difference unit for proportioning said difference signal to said speed signal to obtain said corrected difference signal, and an integrator connected between said multiplier and said circuit means for integrating said corrected difference signal before it is utilized to control said position controlling means.

* * * * *